US008686265B2

(12) United States Patent
Johnston

(10) Patent No.: US 8,686,265 B2
(45) Date of Patent: Apr. 1, 2014

(54) TOPSIDE SPRING TENSION ADJUSTER FOR BASS DRUM PEDALS WITH VARIABLE PIVOT POINT SPRING ROTOR

(76) Inventor: Darrell Johnston, Harbor City, CA (US)

( * ) Notice: Subject to any disclaimer, the term of this patent is extended or adjusted under 35 U.S.C. 154(b) by 0 days.

(21) Appl. No.: 13/437,813

(22) Filed: Apr. 2, 2012

(65) Prior Publication Data

US 2012/0198984 A1 Aug. 9, 2012

Related U.S. Application Data

(63) Continuation-in-part of application No. 13/314,790, filed on Dec. 8, 2011, now Pat. No. 8,455,746.

(60) Provisional application No. 61/420,851, filed on Dec. 8, 2010, provisional application No. 61/470,575, filed on Apr. 1, 2011.

(51) Int. Cl.
*G10D 13/02* (2006.01)

(52) U.S. Cl.
USPC ..... 84/422.1

(58) Field of Classification Search
None
See application file for complete search history.

(56) References Cited

U.S. PATENT DOCUMENTS

| | | | | | |
|---|---|---|---|---|---|
| 1,564,839 | A | | 12/1925 | Evans | |
| 1,909,761 | A | * | 5/1933 | Greenleaf | 84/422.1 |
| 2,027,869 | A | | 1/1936 | La Londe | |
| 2,132,211 | A | | 10/1938 | Hueckstead | |
| 2,446,508 | A | | 8/1948 | Crowell | |
| 3,030,847 | A | * | 4/1962 | Thompson | 84/422.1 |
| 3,930,431 | A | * | 1/1976 | Magadini | 84/422.1 |
| 4,134,325 | A | | 1/1979 | Loftus | |
| 4,235,146 | A | * | 11/1980 | Purdy | 84/422.1 |
| 4,691,613 | A | * | 9/1987 | Jacobson | 84/422.1 |
| 4,756,224 | A | * | 7/1988 | Lombardi | 84/422.1 |
| 4,782,733 | A | | 11/1988 | Herring | |
| 4,819,536 | A | * | 4/1989 | Lombardi | 84/746 |
| 4,829,874 | A | | 5/1989 | Hoshino | |
| 4,873,910 | A | | 10/1989 | Kurosaki | |
| 4,905,565 | A | | 3/1990 | Hoshino | |
| 4,945,802 | A | | 8/1990 | Ruprecht | |
| 4,955,277 | A | | 9/1990 | Carlson | |
| 4,958,549 | A | | 9/1990 | Vukovic | |
| 5,090,289 | A | | 2/1992 | Holcomb | |
| 5,105,706 | A | | 4/1992 | Lombardi | |
| 5,301,592 | A | * | 4/1994 | Johnston | 84/422.1 |

(Continued)

OTHER PUBLICATIONS

U.S. Appl. No. 13/314,790, Notice of Allowance, Feb. 28, 2013.

(Continued)

*Primary Examiner* — Robert W Horn
(74) *Attorney, Agent, or Firm* — Risso & Associates

(57) ABSTRACT

Described is a drum foot pedal with a tension adjuster for adjusting the tension of the spring and corresponding return action of a beater. The device includes a foot pedal and a beater bracket operably connected with the foot pedal such that the beater bracket is actuated in response to force applied to the foot pedal. A rocker component is attached with the beater bracket such that rotational motion of the beater bracket causes a rotational motion of the rocker component. A swivel component is connected with the rocker component. Further, a spring is attached with the swivel component for biasing the beater bracket to force a return action of a beater when force is removed from the foot pedal. Finally, a spring tension adjuster connected with and between the swivel component and spring, the spring tension adjuster operable for allowing a user to selectively adjust tension of the spring.

10 Claims, 9 Drawing Sheets

(56) References Cited

U.S. PATENT DOCUMENTS

| | | | | |
|---|---|---|---|---|
| 5,509,342 | A | 4/1996 | Augsburger | |
| D390,253 | S * | 2/1998 | Bacco | D17/22 |
| 5,714,701 | A * | 2/1998 | Hsieh | 84/422.1 |
| 5,936,177 | A | 8/1999 | Shigenaga | |
| 6,063,993 | A | 5/2000 | Hoshino | |
| 6,166,312 | A | 12/2000 | Brewster et al. | |
| 6,239,342 | B1 * | 5/2001 | Chang | 84/422.1 |
| 6,684,734 | B2 * | 2/2004 | Gatzen | 74/560 |
| 7,197,957 | B2 * | 4/2007 | Gatzen | 74/560 |
| 7,449,626 | B2 | 11/2008 | Chen | |
| 7,550,663 | B2 | 6/2009 | Lin | |
| 7,579,539 | B2 | 8/2009 | Chen | |
| 7,795,520 | B1 * | 9/2010 | Chen | 84/422.1 |
| 7,928,305 | B1 * | 4/2011 | Chen | 84/422.1 |
| 7,956,268 | B1 | 6/2011 | Liao | |
| 8,278,541 | B2 | 10/2012 | Dorfman et al. | |
| 8,455,746 | B2 * | 6/2013 | Johnston et al. | 84/422.1 |
| 2003/0005811 | A1 * | 1/2003 | Hsieh | 84/422.1 |
| 2003/0159563 | A1 * | 8/2003 | Shigenaga | 84/422.1 |
| 2005/0150354 | A1 | 7/2005 | Paul et al. | |
| 2012/0144976 | A1 * | 6/2012 | Johnston et al. | 84/422.1 |
| 2012/0198984 | A1 * | 8/2012 | Johnston | 84/422.1 |

OTHER PUBLICATIONS

Rick Van Horn, "Axis and Axis-E Pedals", Modern Drummer, Feb. 1991, pp. 48-49.

U.S. Appl. No. 07/715,626, Non-Final Rejection, Jan. 24, 1992.

U.S. Appl. No, 07/715,626, Response after Non-Final Action, Mar. 30, 1992.

U.S. Appl. No. 07/715,626, Final Rejection, Jun. 12, 1992.

U.S. Appl. No. 07/715,626, Substitute Specification Filed, Oct. 5, 1992.

U.S. Appl. No. 07/715,626, Advisory Action (PTOL-303), Jan. 4, 1993.

U.S. Appl. No. 07/715,626, Examiner Interview Summary Record (PTOL-413), Sep. 15, 1993.

* cited by examiner

TOPSIDE SPRING TENSION ADJUSTER FOR BASS DRUM PEDALS WITH VARIABLE PIVOT POINT SPRING ROTOR

PRIORITY CLAIM

This is a Continuation-in-Part application of Ser. No. 13/314,790, filed on Dec. 8, 2011, now U.S. Pat. No. 8,455,746 entitled, "Beater Bracket and Variable Drive Lever System with Variable Pivot Point Spring Rotor for Bass Drum Foot Pedals," which is a non-provisional application of U.S. Provisional Application No. 61/420,851, filed on Dec. 8, 2010, entitled, "A21 Beater Bracket and Variable Drive Lever System with Variable Pivot Point Spring Rotor for Bass Drum Foot Pedals." This is ALSO a non-provisional application of U.S. Provisional Application No. 61/470,575, filed on Apr. 1, 2011, and entitled, "Topside Spring Tension Adjuster for Bass Drum Pedals."

BACKGROUND OF THE INVENTION (1) Field of Invention

The present invention relates to drum pedals and, more particularly, to a tension adjuster and variable pivot point spring rotor for adjusting the return action of a beater.

(2) Description of Related Art

Foot pedals have long been used for striking bass drums, since the use of a foot pedal frees both of the drummer's hands for use with snare drums, cymbals or other devices. However, most prior art bass drum pedals have been constructed with a fixed drive action. This means that the drummer must vary the force with which the beater impacts the drum head by varying the force applied by the drummer's foot. Unfortunately, some drummers have a "heavier foot" than others and, hence, must constantly guard against causing the beater to strike the drum head too vigorously, while other drummers have a very "light foot" and, consequently, must exert conscious effort to effect a desired beater impact. Some attempts have been made to provide adjustable drive action. However, the adjustable drive action foot pedals of the prior art have been complex, expensive to produce and difficult to adjust and maintain.

U.S. Pat. No. 5,301,592 (hereinafter referred to as the '592 patent) was devised to address several of the deficiencies listed above. As shown in FIGS. 1 and 2, the '592 patent shows a bass drum foot pedal 10, having a flat elongated base 12 with a foot pedal 14 having one end 16 pivotally secured to a block 18 located adjacent one end 20 of the base 12. The opposite end 22 of the foot pedal 14 is pivotally secured to the lower end 24 of a link member 26 whose upper end 28 is pivotally secured to the lower end of a slide member 30. The slide member 30 is movable along a rod 32 carried by a rocker member 34 and may be secured in a desired position along the rod 32 by suitable means, such as thumbscrew 36. The rocker member 34 is pivotally mounted adjacent the upper end 38 of a column 40 which is fixedly mounted adjacent the forward end 42 of the base 12 and extends vertically upward therefrom. The rocker member 34 is formed with a hole 44 extending therethrough adjacent the outer end 46 of the rocker member 34 to releasably receive the shaft 48 of a suitable beater 50. Clamp means 52 are mounted on the rocker member 34 adjacent the hole 44 to releasably retain the shaft 48 of the beater 50. The rocker member 34 is pivotally mounted on the column 40 by a pivot arm 54 which extends through the upper end 38 of the column 40 and carries a link member 56 on its opposite end 58 and a second link member 60 is pivotally connected between the lower end 62 of link member 56 and the upper end 64 of a spring 66. A flange 68 projects laterally from the column 40 and has an opening 70 extending therethrough to receive the shank 72 of a hook 74 which retains the lower end 76 of the spring 66. A thumbnut 78 serves to permit adjustment of the tension applied by hook 74 to the spring 66 and to retain the hook 74 in a desired position of adjustment. Link member 56 is secured in a desired position of adjustment about the pivot arm 54 by means of a set screw 80 or the like. Finally, a block 81 is mounted on the base 12 adjacent the forward end 42 thereof and an arm 83 is pivotally mounted thereon with a screw 85 threadedly carried adjacent the rear end 87 of arm 83 and clamping means 89 is provided adjacent the opposite end of arm 83 to clamp the bass drum pedal 10 to the rim of a bass drum, not shown.

The '592 patent was a significant improvement over the prior art in that the slide member 30 is adjustable by moving along the rod 32 to vary the impact force and strike point of the beater 50.

While the '592 patent describes a very desirable product that provides for a wide range of adjustability of optimizing performance, there are circumstances where added adjustability may be desired to vary the performance of the drum pedal.

Thus, a continuing need exists for additional adjustable components for bass drum pedals.

SUMMARY OF INVENTION

The present invention provides an improvement over the prior art through a tension adjuster and variable pivot point spring rotor for adjusting the return action of a beater. Thus, the present invention is a bass drum pedal that includes a base and a foot pedal having one end pivotally secured to a front end of said base. A column is connected to the base adjacent to the opposite end of the base from the front end and extending longitudinally above the base. A beater bracket is pivotally connected with the column. The beater bracket is formed to secure a shaft for a beater. A link member is included for linking the foot pedal to the beater bracket to actuate the beater bracket in response to a force applied to the foot pedal. A rocker component is attached with the beater bracket such that rotational motion of the beater bracket causes a rotational motion of the rocker component. A swivel component is connected with the rocker component. Further, a bias device is attached with the swivel component for biasing the beater bracket to force a return action of a beater when force is removed from the foot pedal.

In another aspect, the rocker component includes a slot formed therethrough that allows the swivel component to be attached at varying locations along the rocker component.

In yet another aspect, the bias device is a coil spring.

In another aspect, a spring tension adjuster is connected with and between the swivel component and coil spring. The spring tension adjuster is operable for allowing a user to selectively adjust tension of the coil spring.

The spring tension adjuster further includes a guide rod attached with the swivel component; a slide block slidably attached with the guide rod such that the slide block is operable for sliding forward and backward along the guide rod; a tension screw attached with the swivel component and the slide block to allow a user to selectively fix the location of the slide block along the guide rod; and a spring connector for attaching the spring tension adjuster with the coil spring, whereby through use of the tension screw and selectively fixing the location of the slide block, a user can selectively adjust the tension of the coil spring.

Finally, the present invention includes a method for forming and using the device described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
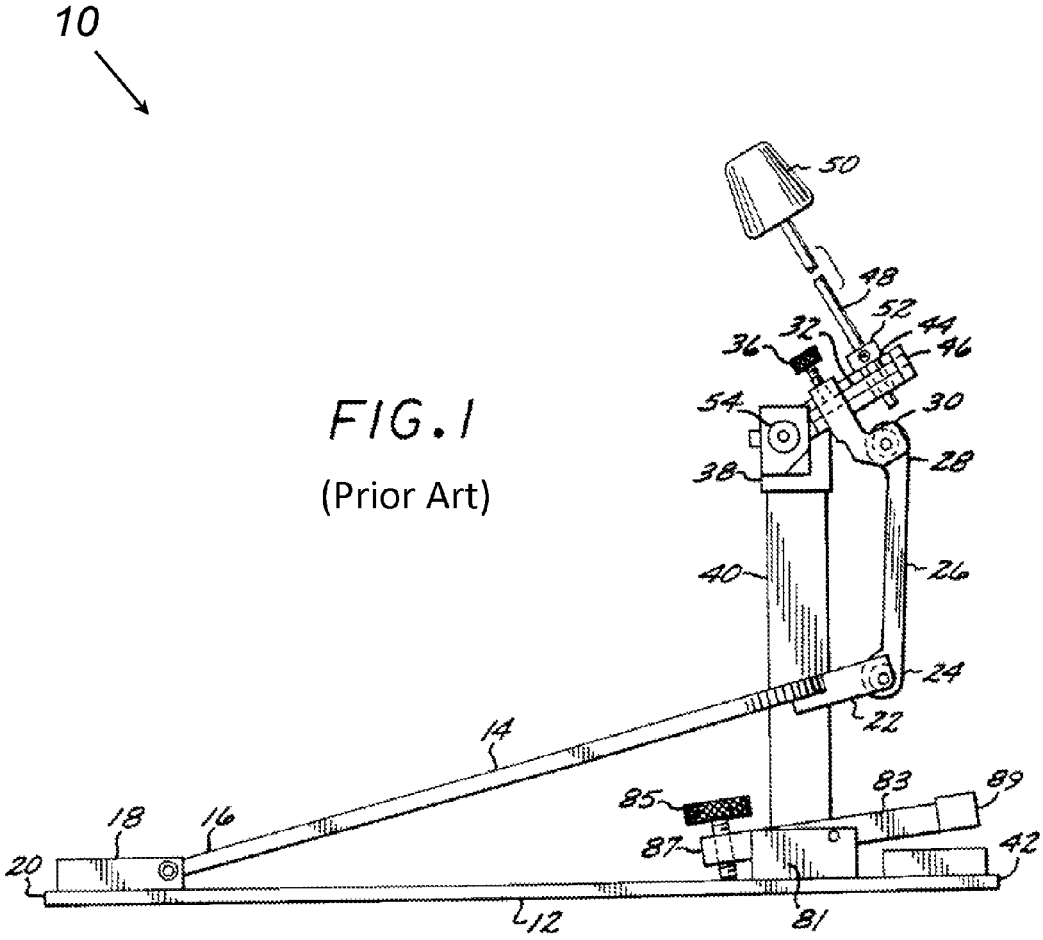
FIG. 1 (Prior Art)
FIG. 1 is a right side view of a bass drum foot pedal of the prior art.

The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

As noted herein, the present invention is directed to an improvement over existing base drum pedals by providing such pedals with additional adjustability. For example and as depicted in the prior art of FIG. 2, a first link member 56 and second link member 60 are included to provide pivotability with a spring 66. Through modifications to the link members and spring connections, a user can increase the rate at which the spring is engaged, which affects the return action of the beater.

Thus, as shown in FIGS. 3A through 11, the present invention is directed to a variable spring rotor (to optionally replace the first and second link members described above) and top-side spring tension adjuster, which increase the rate at which the spring is engaged to effect the return action of the beater.

Figure 2:
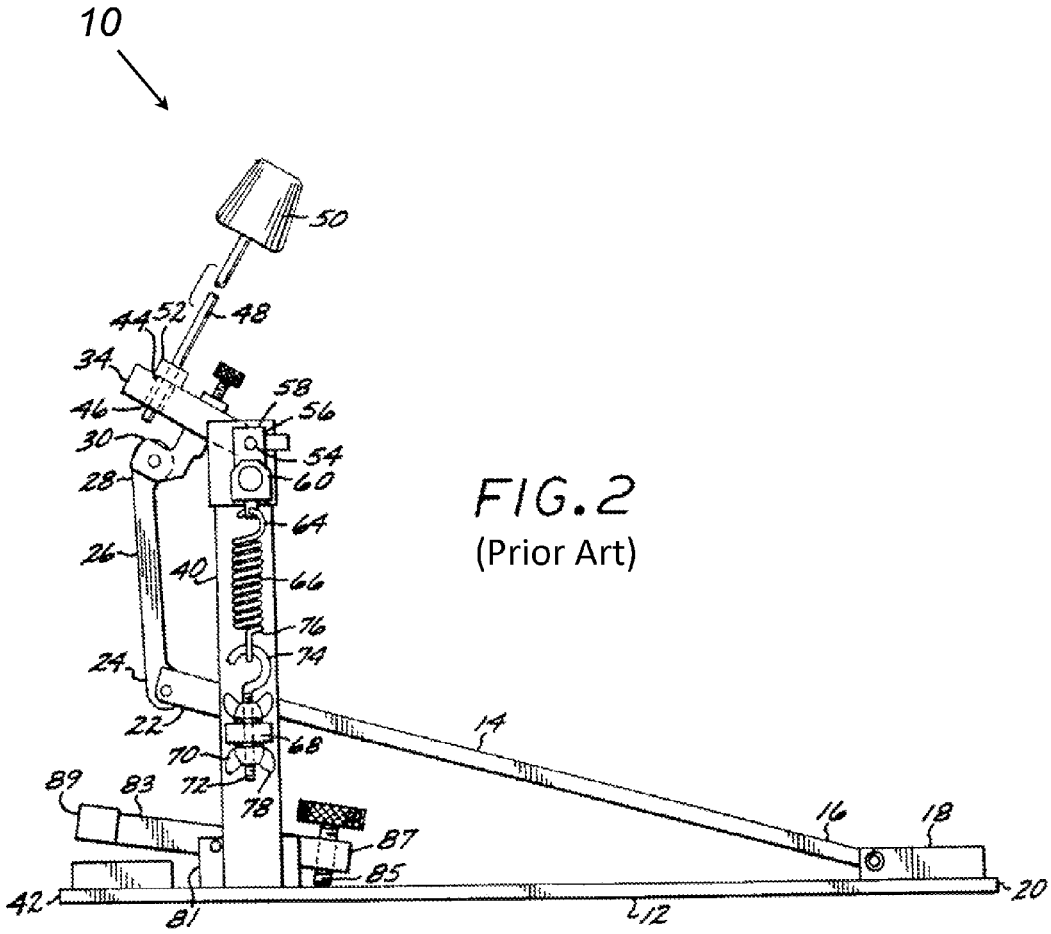
FIG. 2 (Prior Art)
FIG. 2 is a left side view of the bass drum foot pedal of FIG. 1.
Figure 3A:
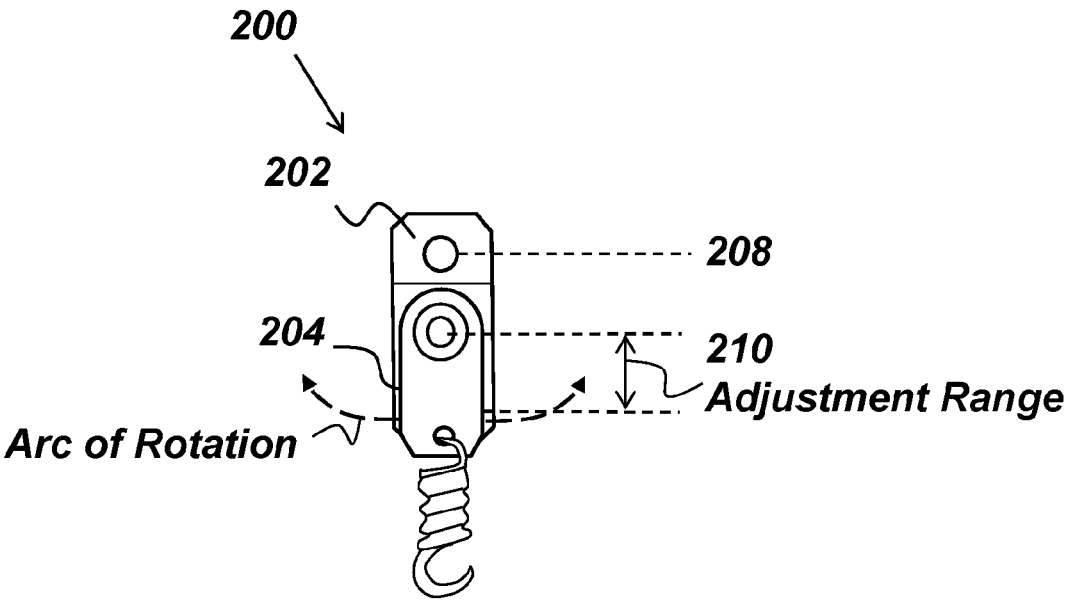
FIG. 3A is an illustration of a variable pivot point spring rotor according to the present invention, depicting its rocker and swivel components.
Figure 3B:
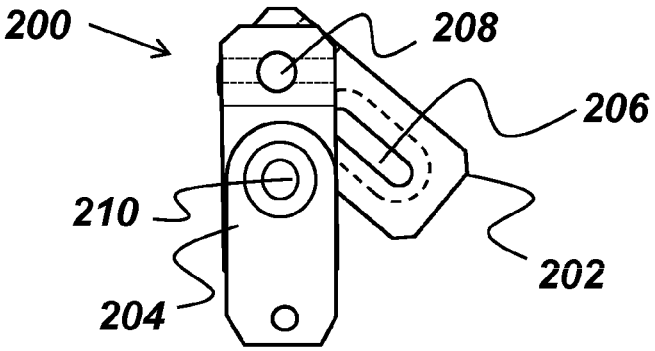
FIG. 3B is an illustration of the variable pivot point spring rotor according to the present invention.

As shown in FIGS. 3A and 3B, the variable pivot point spring rotor 200 includes a rocker component 202 and a swivel component 204, which can be used in place of the first link and second link (depicted as elements 56 and 60 in FIG. 2), respectively. As shown in FIG. 3B, the rocker component 202 includes a slot 206 formed therethrough that allows the swivel component 204 to be attached at varying locations along the rocker component 202. Importantly and as depicted in both FIGS. 3A and 3B, by altering the location of attachment, a user can effectively alter the distance between the rocker axis of rotation 208 and the swivel axis of rotation 210.

Figure 4A:
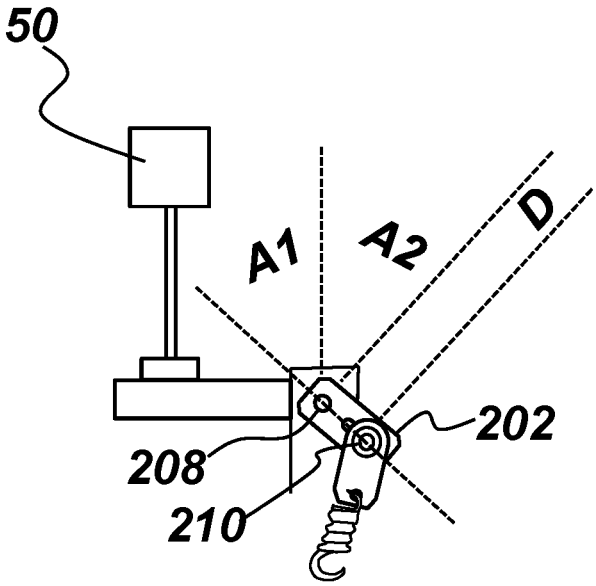
FIG. 4A is an illustration of the variable pivot point spring rotor according to the present invention.
Figure 4B:
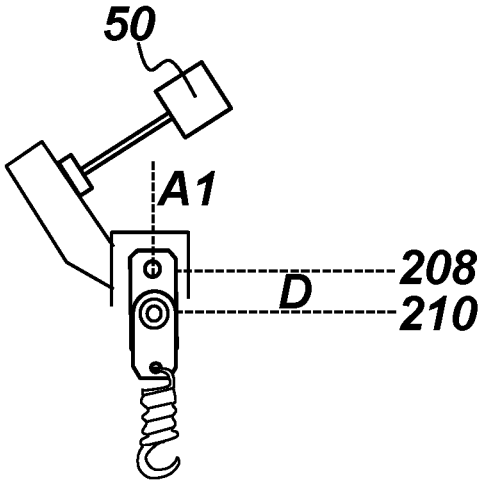
FIG. 4B is an illustration of the variable pivot point spring rotor according to the present invention.

FIGS. 4A and 4B depict various angles that are provided by the rocker component. For example, A1 is the angle of the rocker component 202 as the beater 50 hits a drumhead. D is the distance between the rocker axis of rotation 208 and the swivel axis of rotation 210. Further, A2 is an angle that is equal to A1 when the beater 50 is in full reverse position (not depicted).

Alternatively and as depicted in FIG. 4B, A1 is zero when the beater 50 is at rest. Again, D is the distance between the rocker axis of rotation 208 and the swivel axis of rotation 210.

Figure 5:
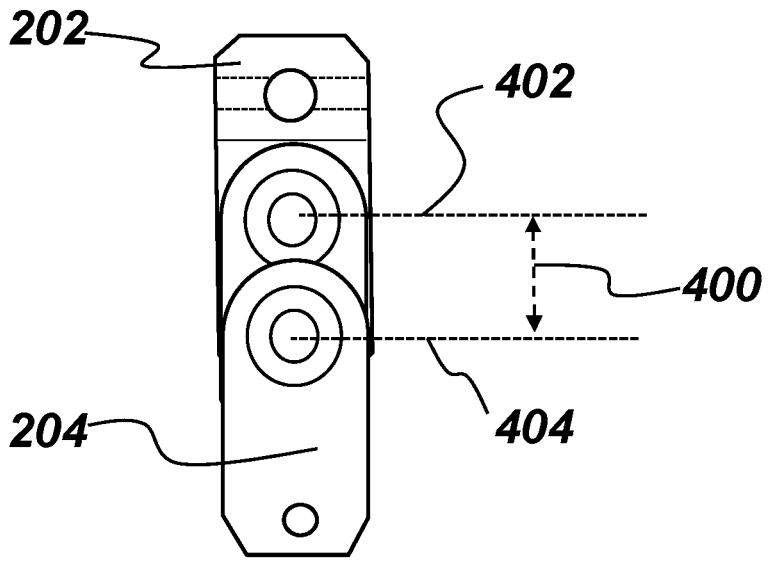
FIG. 5 is an illustration of the variable pivot point spring rotor according to the present invention.

FIG. 5 is an illustration depicting that the swivel component 204 can be set at any position in the slide range 400 of the rocker component 202. The figure illustrates the swivel component 204 being set in the top position 402 and, alternatively, the bottom (lowest) position 404.

Figure 6:
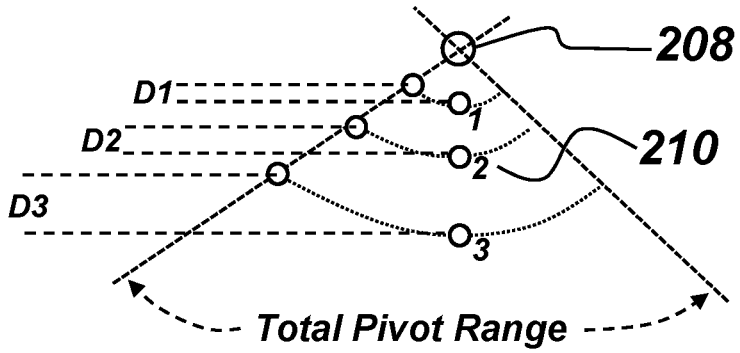
FIG. 6 is an illustration depicting a pivot range of the variable pivot point spring rotor.

FIG. 6 is an illustration depicting how the pivot range is impacted by altering the distances between the rocker axis of rotation 208 and the swivel axis of rotation 210 (illustrated in positions 1, 2, and 3). As the swivel component is moved down the rocker component and the distance between the rocker axis of rotation 208 and swivel axis of rotation 210 increases, the amount of overall spring deflection (i.e., D1, D2, and D3) also increase.

Figure 7A:
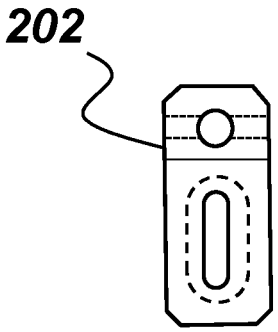
FIG. 7A is a front-view illustration of the rocker component.
Figure 7B:
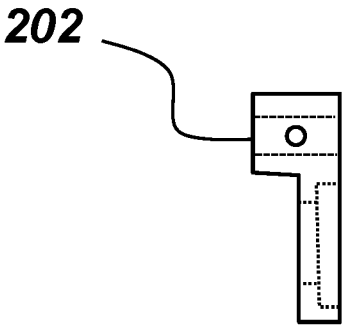
FIG. 7B is a right, side-view illustration of the rocker component.
Figure 8A:
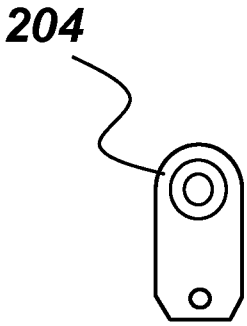
FIG. 8A is a front-view illustration of the swivel component.
Figure 8B:
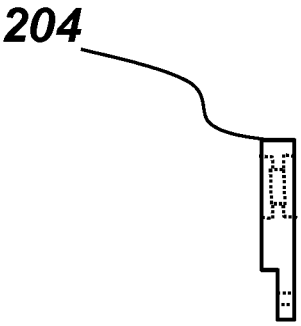
FIG. 8B is a right, side-view illustration of the swivel component.

For further understanding, FIG. 7A is a front-view illustration of the rocker component 202, while FIG. 7B is a right, side-view illustration of the rocker component 202. Alternatively, FIG. 8A is a front-view illustration of the swivel component 204 while FIG. 8B is a right, side-view illustration of the swivel component 204.

Figure 9:
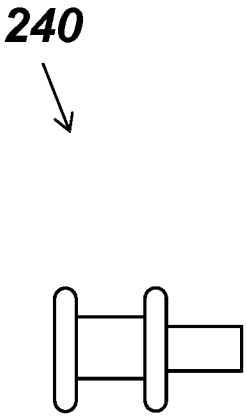
FIG. 9 is an illustration of a swivel axle.

The swivel component is attached with rocker component with a swivel axle. As shown in FIG. 9, the swivel axle 240 allows the swivel component to rotate about the swivel axle while the swivel axle remains fixedly attached with the rocker component. In other words, the swivel axle 240 can be selectively and fixedly attached (e.g., using a clamp means) anywhere along the slot of the rocker component, thereby fixing the distance between the rocker axis of rotation and the swivel axis of rotation. Further, ball bearings or any other suitable rotatable means can be used to assist the swivel component with freely rotating about the swivel axle 240.

Figure 10:
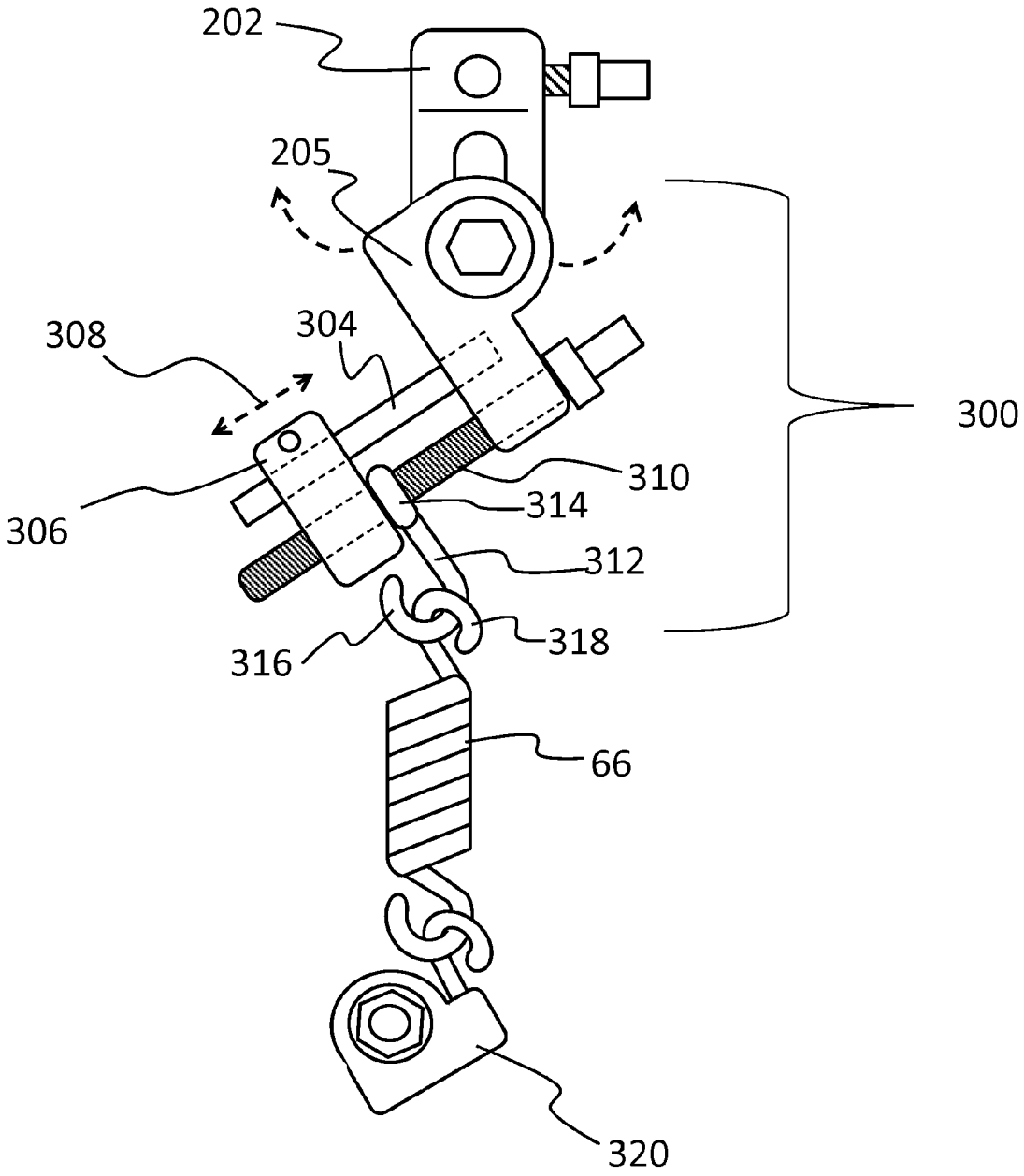
FIG. 10 is an illustration of a spring tension adjuster according to the present invention.

To provide further adjustability of the spring tension, the swivel component (shown in FIGS. 3A through 8B as element 204) can be supplemented with a spring tension adjuster. As shown in FIG. 10, the spring tension adjuster 300 facilitates tension adjustment of extension type coil spring 315 with a "drum key" (common tool for drummers), and positions the adjustment point so that convenience is greatly improved. In doing so, the spring tension adjuster 300 includes components that allow a user to adjust the tension of the spring 315, which ultimately effects the return action of the beater. The spring 315 operates as a bias device for biasing the beater bracket (as described below) to force a return action of a beater when force is removed from the foot pedal (i.e., the user's foot is removed).

The spring tension adjuster 300 is any mechanism or device that allows a user to selectively adjust the tension of the spring 315. As a non-limiting example, the spring tension adjuster 300 includes the swivel component 205 that is attached with the rocker component 202. It should be noted that the swivel component 205 is analogous to the swivel component as depicted FIGS. 3A through 8B; however, the swivel component 205 as depicted in FIGS. 10 and 11 also includes the guide rods 304 and tension screws 310 as described in further detail below.

The swivel component 205 includes one or more guide rods 304 (e.g., although one is illustrated, two or more are desirably included) that extend from the swivel component 205. A slide block 306 is slidably attached with the guide rods 304. The slide block 306 is operable for sliding 308 forward and backward along the guide rods 304. To control and affix the position of the slide block 306 along the slide rods 304, a tension screw 310 passes through the swivel component 205 into the slide block 306. Thus, by rotating the tension screw 310, the slide block 306 is pulled toward or away from the swivel component 205. The tension screw 310 can be rotated using any suitable mechanism or device. As a non-limiting example, the tension screw 310 includes a square head that is formed to complement a drum key, thereby enabling a user to easily adjust the spring tension with readily available tools.

A spring connector 312 is included to allow the spring 315 to easily attach with the spring tension adjuster 300. The spring connector is any suitable mechanism or device that allows for the spring to attach with the spring tension adjuster 300. As a non-limiting example, the spring connector 312 includes a first metal loop that wraps around the tension screw 310 and second metal loop for attaching with a spring loop 318. In another aspect, the spring connector 312 is simply a top portion of the spring 315 (such as the spring loop 318) that allows the spring 315 to connect directly to the tension screw 312. In yet another aspect, the spring connector 312 is attached directly with the slide block 306 (such as a ring that protrudes from the slide block 306). In either event, the spring connector 312 allows the tension of the spring 315 to be adjusted based on the position of the slide block 306 along the tension screw 310. Finally, a spring anchor swivel 320 (with an eye loop) is included to anchor the spring 315 and allow for automatic alignment of the loop ends of the extension spring 315, thereby preventing twisting along the long axis of the spring 315, which maintains completely silent operation.

Figure 11:
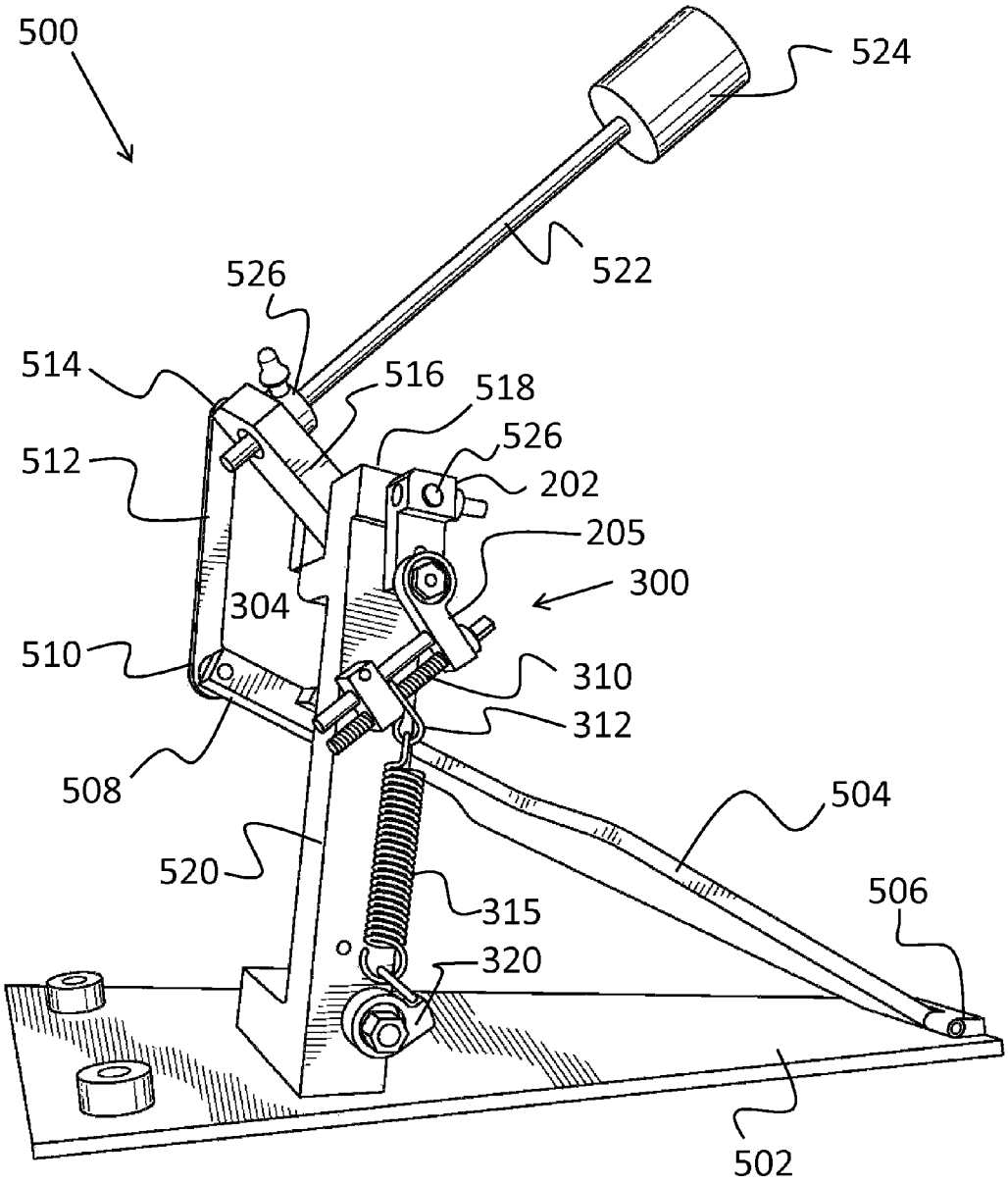
FIG. 11 illustrates a drum pedal according to the present, depicting the drum pedal with the spring tension adjuster.

FIG. 11 illustrates a drum pedal 500 according to the present, depicting the drum pedal 500 with the spring tension adjuster 300. Thus, the drum pedal 500 includes a base 502 (e.g., flat elongated base) with a foot pedal 504. One end of the foot pedal 504 is pivotally attached with the base 502 (e.g., via a block 506 located adjacent to an end of the base 502). The opposite end 508 of the foot pedal 504 is pivotally secured to the lower end 510 of a link member 512 whose upper end 514 is pivotally secured to a beater bracket 516. Although not depicted, the present invention can also include a slide member and rod system as depicted in FIGS. 1 and 2.

The beater bracket 516 is pivotally mounted adjacent the upper end 518 of a column 520 which is fixedly mounted adjacent the forward end (or any suitable location) of the base 502 and extends vertically upward therefrom. The beater bracket 516 is formed with a hole extending therethrough to releasably receive the shaft 522 of a suitable beater 524. Clamp means 526 are mounted on the beater bracket 516 adjacent the hole to releasably retain the shaft 522 of the beater 524. The beater bracket 516 is pivotally mounted on the column 520 by a pivot arm 526 which extends through the upper end 518 of the column 520.

The rocker component 202 is affixed with the pivot arm 526. Thus, the rocker component 202 is attached with the beater bracket 516 such that rotational motion of the beater bracket 516 causes a similar rotational motion of the rocker component 516, and vice versa.

As noted above, the spring tension adjuster 300 is rotatably attached with the rocker component 202. Thus, the swivel component 205 is rotatably attached with rocker component 202. A slide block 306 is connected with the swivel component 205 via the guide rods 304 and tension screw 310. A spring connector 312 affixes the spring 315 with the slide block 306 on one end, while the spring 316 is attached with the column 520 (or base if desired) via the spring anchor swivel 320. Thus, as can be appreciated by one skilled in the art, through the use of the rocker component 202 and the spring tension adjuster 300, a user can effectively increase and/or adjust the rate at which the beater 524 returns when in use.

As can be appreciated, numerous variations and modifications can be made without departing from the spirit of the present invention. Therefore, it should be clearly understood that the forms of the present invention described above and shown in the figures of the accompanying drawings are illustrative only and are not intended to limit the scope of the present invention.

The invention claimed is:

1. A bass drum pedal comprising:

a base;

foot pedal having one end pivotally secured to a front end of said base;

a column connected to said base adjacent to the opposite end of said base from said front end and extending longitudinally above said base;

a beater bracket pivotally connected with the column, the beater bracket formed to secure a shaft for a beater;

link member for linking the foot pedal to the beater bracket to actuate the beater bracket in response to a force applied to the foot pedal;

a rocker component attached with the beater bracket such that rotational motion of the beater bracket causes a rotational motion of the rocker component;

a swivel component connected with the rocker component;

a bias device attached with the swivel component for biasing the beater bracket to force a return action of a beater when force is removed from the foot pedal;

wherein the rocker component includes a slot formed therethrough that allows the swivel component to be attached at varying locations along the rocker component;

wherein the bias device is a coil spring; and further comprising a spring tension adjuster connected with and between the swivel component and coil spring, the spring tension adjuster operable for allowing a user to selectively adjust tension of the coil spring.

2. The bass drum pedal of claim 1, wherein the spring tension adjuster further includes:

a guide rod attached with the swivel component;

a slide block slidably attached with the guide rod such that the slide block is operable for sliding forward and backward along the guide rod;

a tension screw attached with the swivel component and the slide block to allow a user to selectively fix the location of the slide block along the guide rod; and a spring connector for attaching the spring tension adjuster with the coil spring, whereby through use of the tension screw and selectively fixing the location of the slide block, a user can selectively adjust the tension of the coil spring.

3. A bass drum pedal comprising:

a base;

a foot pedal having one end pivotally secured to a front end of said base;

a column connected to said base adjacent to the opposite end of said base from said front end and extending longitudinally above said base;

a beater bracket pivotally connected with the column, the beater bracket formed to secure a shaft for a beater;

link member for linking the foot pedal to the beater bracket to actuate the beater bracket in response to a force applied to the foot pedal;

a rocker component attached with the beater bracket such that rotational motion of the beater bracket causes a rotational motion of the rocker component;

a swivel component connected with the rocker component;

a bias device attached with the swivel component for biasing the beater bracket to force a return action of a beater when force is removed from the foot pedal; and a spring tension adjuster connected with and between the swivel component and bias device, the spring tension adjuster operable for allowing a user to selectively adjust tension of the bias device.

4. The bass drum pedal of 3, wherein the spring tension adjuster further includes:

a guide rod attached with the swivel component;

a slide block slidably attached with the guide rod such that the slide block is operable for sliding forward and backward along the guide rod;

a tension screw attached with the swivel component and the slide block to allow a user to selectively fix the location of the slide block along the guide rod; and a spring connector for attaching the spring tension adjuster with the bias device, whereby through use of the tension screw and selectively fixing the location of the slide block, a user can selectively adjust the tension of the bias device.

5. A bass drum pedal comprising:

a foot pedal a beater bracket operably connected with the foot pedal such that the beater bracket is actuated in response to force applied to the foot pedal, the beater bracket formed to secure a shaft for a beater;

a spring operably attached with the beater bracket for biasing the beater bracket to force a return action of a beater when force is removed from the foot pedal;

a spring tension adjuster operably connected with and between the spring and the beater bracket, the spring tension adjuster operable for allowing a user to selectively adjust tension of the spring;

a rocker component attached with the beater bracket such that rotational motion of the beater bracket causes a rotational motion of the rocker component; and a swivel component connected with the rocker component, with tension adjuster connected with the swivel component and the spring.

6. The bass drum pedal as set forth in Claim 5, wherein the rocker component includes a slot formed therethrough that allows the swivel component to be attached at varying locations along the rocker component.

7. A bass drum pedal comprising:

a foot pedal a beater bracket operably connected with the foot pedal such that the beater bracket is actuated in response to force applied to the foot pedal, the beater bracket formed to secure a shaft for a beater a rocker component attached with the beater bracket such that rotational motion of the beater bracket causes a rotational motion of the rocker component a swivel component connected with the rocker component; and a bias device attached with the swivel component for biasing the beater bracket to force a return action of a beater when force is removed from the foot pedal;

wherein the rocker component includes a slot formed therethrough that allows the swivel component to be attached at varying locations along the rocker component;

wherein the bias device is a coil spring; and further comprising a spring tension adjuster connected with and between the swivel component and coil spring, the spring tension adjuster operable for allowing a user to selectively adjust tension of the coil spring.

8. The bass drum pedal of claim 7, wherein the spring tension adjuster further includes:

a guide rod attached with the swivel component;

a slide block slidably attached with the guide rod such that the slide block is operable for sliding forward and backward along the guide rod;

a tension screw attached with the swivel component and the slide block to allow a user to selectively fix the location of the slide block along the guide rod; and a spring connector for attaching the spring tension adjuster with the coil spring, whereby through use of the tension screw and selectively fixing the location of the slide block, a user can selectively adjust the tension of the coil spring.

9. A bass drum pedal comprising:

a foot pedal a beater bracket operably connected with the foot pedal such that the beater bracket is actuated in response to force applied to the foot pedal, the beater bracket formed to secure a shaft for a beater a rocker component attached with the beater bracket such that rotational motion of the beater bracket causes a rotational motion of the rocker component;

a swivel component connected with the rocker component;

a bias device attached with the swivel component for biasing the beater bracket to force a return action of a beater when force is removed from the foot pedal; and a spring tension adjuster connected with and between t he swivel component and bias device, the spring tension adjuster operable for allowing a user to selectively adjust tension of the bias device.

10. The bass drum pedal of claim 9 wherein the spring tension adjuster further includes;

a guide rod attached with the swivel component;

a slide block slidably attached with the guide rod such that the slide block is operable for sliding forward and backward along the guide rod;

a tension screw attached with the swivel component and the slide block to allow a user to selectively fix the location of the slide block along the guide rod.; and a spring connector for attaching the spring tension adjuster with the bias device, whereby through use of the tension screw and selectively fixing the location of the slide block, a user can selectively adjust the tension of the bias device.

* * * * *